US006062305A

United States Patent [19]

Persson

[11] Patent Number: 6,062,305

[45] Date of Patent: May 16, 2000

[54] PLATE HEAT EXCHANGER

[75] Inventor: Lars Persson, Marblehead, Mass.

[73] Assignee: EP Technology AB, Malmo, Sweden

[21] Appl. No.: 09/051,913

[22] PCT Filed: Sep. 24, 1996

[86] PCT No.: PCT/SE96/01188

§ 371 Date: Apr. 27, 1998

§ 102(e) Date: Apr. 27, 1998

[87] PCT Pub. No.: WO97/16691

PCT Pub. Date: May 9, 1997

[30] Foreign Application Priority Data

Oct. 28, 1995 [DE] Germany ..... 195 40 271

[51] Int. Cl.[7] ..... F28F 3/10

[52] U.S. Cl. ..... 165/167; 165/DIG. 365

[58] Field of Search ..... 165/167, DIG. 365

[56] References Cited

U.S. PATENT DOCUMENTS

| | | | |
|---|---|---|---|
| 3,925,167 | 12/1975 | Rodgers | 165/167 X |
| 4,063,591 | 12/1977 | Usher . | |
| 4,635,714 | 1/1987 | Almgvist et al. . | |
| 4,660,633 | 4/1987 | Fischer . | |
| 5,069,276 | 12/1991 | Seidel | 165/167 X |

FOREIGN PATENT DOCUMENTS

| | | | |
|---|---|---|---|
| 4020735 | 1/1992 | Germany | 165/167 |
| 6507257 | 12/1965 | Netherlands | 165/167 |
| 88695 | 3/1937 | Sweden . | |
| 1672193 | 8/1991 | U.S.S.R. | 165/167 |
| 249184 | 3/1926 | United Kingdom . | |
| 520610 | 4/1940 | United Kingdom | 165/167 |
| 967640 | 8/1964 | United Kingdom . | |
| 1240039 | 4/1970 | United Kingdom . | |
| 2054817 | 2/1981 | United Kingdom | 165/167 |

*Primary Examiner*—Leonard Leo

*Attorney, Agent, or Firm*—Oblon, Spivak, McClelland, Maier & Neustadt, P.C.

[57] ABSTRACT

A plate heat exchanger including heat exchanger plates arranged adjacent to each other and in a compressed pack, the heat exchanger plates each having openings aligned with each other and channels configured to receive a heat emitting medium and a heat absorbing medium alternately via the openings. The plate heat exchanger further includes gaskets arranged on a periphery of the openings and between two adjacent heat exchanger plates in gasket regions. The heat exchanger plates have corrugations extending from the openings in a substantially radial direction and uninterrupted through the gasket regions. Corrugations hills and corrugations troughs of adjacent heat exchanger plates cross at crossing points such that adjacent heat exchanger plates support each other at the crossing points. The gasket between the adjacent heat exchanger plates is flanked by the crossing points so that the gasket varies in cross-section to be adapted to a profile of the heat exchanger plates and so that a substantially same gasket pressure is obtained over the extent of the gasket in a compressed condition.

19 Claims, 5 Drawing Sheets

PLATE HEAT EXCHANGER

BACKGROUND OF THE INVENTION

1. Field of the Invention

The present invention relates to a plate heat exchanger comprising alternately arranged plates compressed together to a pack, forming closed channels by means of gaskets arranged between the plates, alternately for a heat emitting and a heat absorbing medium. These channels may be supplied with the respective medium through entry and exit openings in the plates aligned with each other, profiles extending from the entry and exit openings, and in the region of these profiles, gaskets for separating the entry and exit openings, respectively, from the heat exchanger surfaces are arranged alternately between pairs of plates.

2. Discussion of the Background

The gaskets of plate heat exchangers of this type are usually arranged in flat gasket grooves supporting the gasket laterally. In a known way, the intake and outlet region of the entry and exit openings on the heat exchanger surfaces as such form the weakest points of the gasket. In this region, a gasket is arranged only in every second channel while the heat transferring medium encountering the adjacent plate flows in each interposed channel, the gasket groove forming an undesired flow resistance. In the region under-flowed in this way, the gasket groove bottom does not obtain a sufficient metallic support. Since it is also flat and not embossed in the conventional way, it may deform plastically and elastically, locally reducing the gasket pressure. The reduced gasket pressure results in that a leakage may occur in this region even at lower pressures of the heat exchange medium as well as in other regions of the gasket.

From the state of the art, structures and measures, respectively, for mitigating or reducing the leakiness in the flow region of the entry and exit openings of the plate are known. A known measure consists in partially enlarging the gasket in this region. However, this possibility is limited, since a plastic deformation of the gasket groove bottom still will occur.

Another solution is disclosed in DE-AS-23 09 743. Here a lateral support of the gasket groove bottom is obtained by a suitable embossment.

The patent document DE 32 39 004 C2 discloses another solution approach. Here the gasket groove bottom is reinforced by additional embossments.

The solution according to GB-PS 1 020 045 goes further than the solutions mentioned above, in that the embossments of the gasket groove bottom is metallically supported by the respective following plate, however, without adapting the form of the gasket to the embossment. In GB 2 128 726 A, a gasket is also fillingly adapted to the embossment.

With this state of the art, the problem of the tightness in the outlet region of the entry and exit openings is solved in a satisfactory manner. However, in all these solutions the known gasket groove remains in its basic form and the advantage of the direct support is traded against a reduction of the flow cross-section for the entering and exiting medium.

SUMMARY OF THE INVENTION

Thus, according to a first aspect of the present invention, the object of the present invention is to provide a plate heat exchanger of the above described type, wherein a safe seal is obtained while obviating a conventional gasket groove in the outlet region of the entry and exit openings of the heat exchanger plates.

According to a second aspect of the present invention, a further object of the present invention is to provide a plate heat exchanger wherein a safe seal is obtained while obviating a conventional gasket groove in the peripheral region of the heat exchanger surfaces of the heat exchanger plates.

According to a third aspect of the present invention, a still further object of the present invention is to provide a method of producing a plate heat exchanger wherein the gasket is vulcanized in a vulcanization press using a heat exchanger plate as a press mould in the vulcanization press.

According to the first aspect of invention, this object is solved by means of a plate heat exchanger wherein the profiles extending from the entry and outlet openings are extending in a substantially radial direction to the heat exchanger surfaces and thereby continuously traverse the length of the gasket and cross the corresponding profiles of the adjacent plate, such that the extent of the gasket from the crossing point of the corrugation hills of one plate with the corrugation troughs of the other plate is flanked on both sides, whereby the gasket arranged between the plates has a varying cross-section to be adapted to a corrugation of the plates in this region, so that, in compressed condition, substantially the same specific gasket pressure is obtained over the whole extent of the gasket.

According to the second aspect of invention, this object is solved by means of a plate heat exchanger wherein the corrugations of the heat exchanger surfaces extend uninterrupted to the edge of the heat exchanger, the peripheral gasket being arranged between the heat exchanger surfaces, such that the extent of the peripheral gasket is flanked on both sides by the crossing points of the corrugation hills of one plate with the corrugation troughs of the other plate, the peripheral gasket arranged between the heat exchanger plates varying in cross-section to be adapted to the profile of the heat exchanger surfaces in this region.

According to the third aspect of invention, this object is solved by means of a method of producing a plate heat exchanger wherein the gasket is vulcanized in a vulcanization press using a heat exchanger plate as a press mould.

Further embodiments of the invention are defined in the accompanying claims.

With respect to the prior art, the present invention obviates completely a specific gasket groove and hence a holohedral gasket space. Instead, by a special configuration of the corrugation in the region of the outlet region of the entry and exit openings and, preferably, in the peripheral region, the gasket is shaped so that the gasket still is flanked laterally, while the tightness is ensured by a special gasket form adapted to this corrugation, the corrugation extending radially from the entry and exit openings to the heat exchanger surfaces and to the edge of the heat exchanger surfaces, respectively. These corrugations cross corrugations shaped in the same way of the adjacent plate. The gasket is adapted to the crossing wave-form formed in this way at both sides, that is the cross-section of the gasket varies corresponding to the profile and is positioned such that, in compressed condition, substantially the same specific gasket pressure is obtained over the whole gasket.

Because of the radial configuration of the corrugation the gasket space tapers from the heat exchanger surfaces on which the medium pressure impinges to the entry and exit openings and the gasket is wedged by the working pressure of the medium in this tapered cross-section, whereby it is additionally supported by the crossing points following thereafter.

The claimed invention presents the following advantages over the prior solutions:

The uninterrupted continuous corrugation in the region of the gasket causes a high stiffness, whereby the required gasket pressure is ensured in this region. By obviating the gasket groove chamber an optimized flow channel is obtained for the underflowing heat exchanging medium and corresponding small pressure losses. Additionally, by obviating the gasket groove chamber smaller shaping ratios are made possible and thereby a better embossability in the production of heat exchanger plates, thus reducing the cracking risk in the metal shaping.

The uninterrupted corrugations to the edge of the heat exchanger plate render the heat exchanger plate suitable for use in a soldered plate heat exchanger. Thus, the same plates may be used in both a plate heat exchanger of the clamping frame type and of the soldered type reducing the overall production costs.

Using a heat exchanger plate in a vulcanization press as a press mould means that the gasket is vulcanized directly on the heat exchanger plate resulting in a firm adhesion of the gasket to the heat exchanger plate.

In further embodiments of the invention the radial corrugation extending from the entry and exit openings intersects the gasket at an angle of 50 to 80°, preferably of 70°. With this angle of intersection, the position of the crossing points of the corrugation are determined, on one hand, and the flow passage between the heat exchanger plates in this region is defined in a flow promoting way, on the other hand. Thereby, the corrugation of the heat exchanger plates forming a flow passage in the preferred embodiment (70°) is arranged only at approximately 20° to the flow from the entry and exit openings to the heat exchanger surfaces, so that the corresponding low pressure losses are obtained.

BRIEF DESCRIPTION OF THE DRAWINGS

The present invention will be described hereinafter with reference to an embodiment and with reference to the accompanying drawings, in which.

DISCUSSION OF THE PREFERRED EMBODIMENTS

Figure 1:
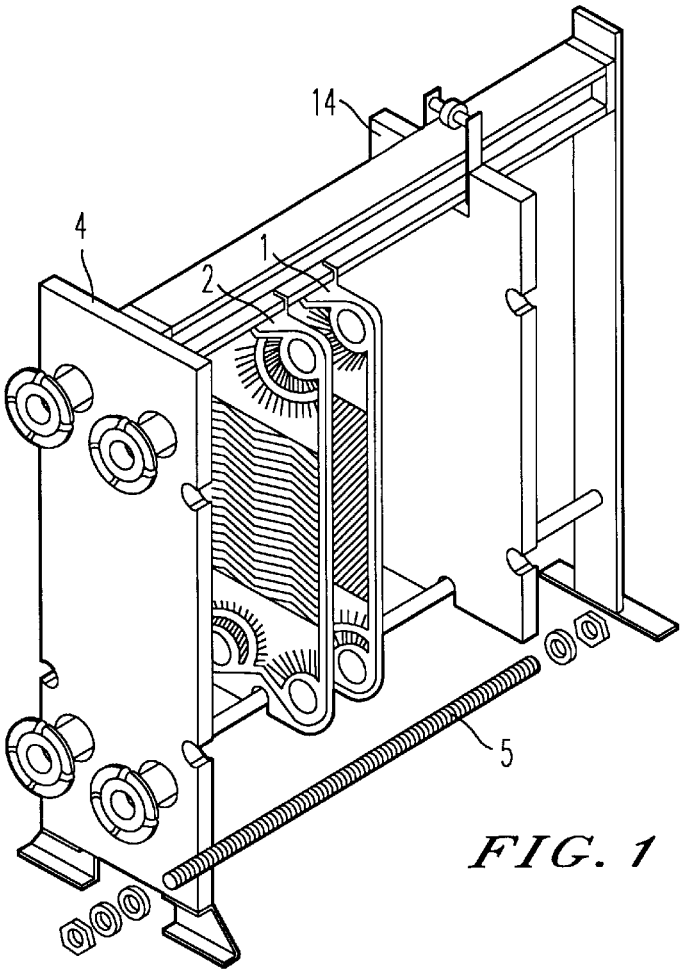
FIG. 1 is an isometric view of a heat exchanger according to the prior art.

In the heat exchanger shown in FIG. 1, for the sake of better overview, only two plates 1, 2 are shown. The clamping plates 4, 14 between which the plate pack is compressed, are not yet tightened by the tightening screws 5 in the open condition shown. The further parts of the heat exchanger frame are not particular or do not have a bearing on the invention, respectively.

Figure 2:
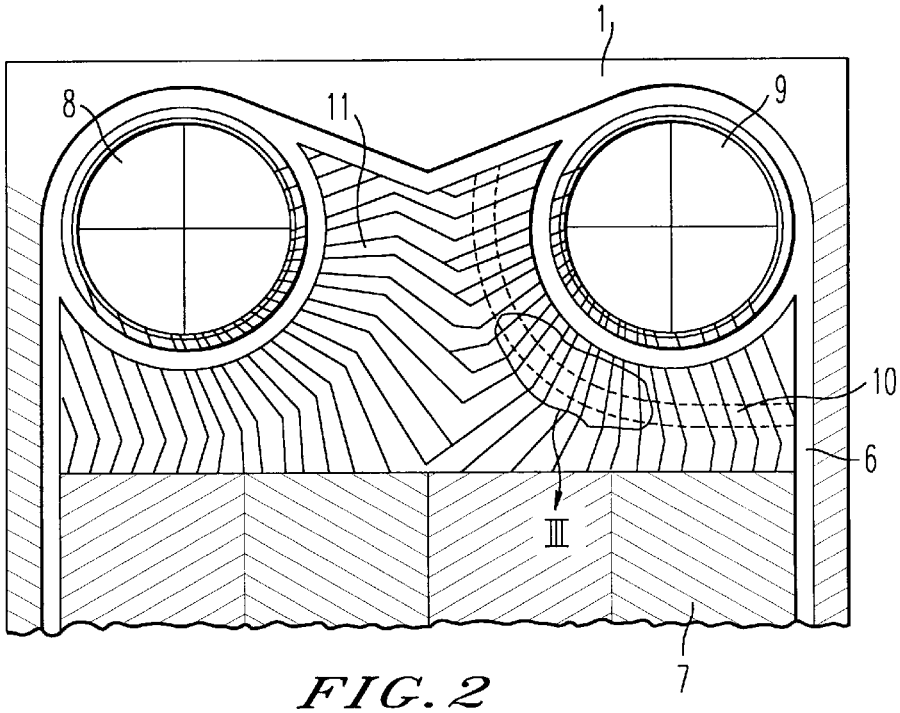
FIG. 2 is a plan view of a heat exchanger plate in accordance with the first aspect of the invention, only the top portion of the plate being illustrated.

In the illustration of FIG. 2, enlarged with respect to FIG. 1, of a portion of a heat exchanger plate, the entry and exit openings, respectively, of the heat exchanging medium are designated by 8 and 9. From these openings 8, 9, corrugations extend radially or in a fan-like way, in the embodiment shown, radially and rotated about 20°, to heat exchanger surface 7 the ridge lines of the corrugation hills of this profile being designated by 11. Between the corrugation hills the correspondingly formed corrugation troughs are extending.

Figure 3:
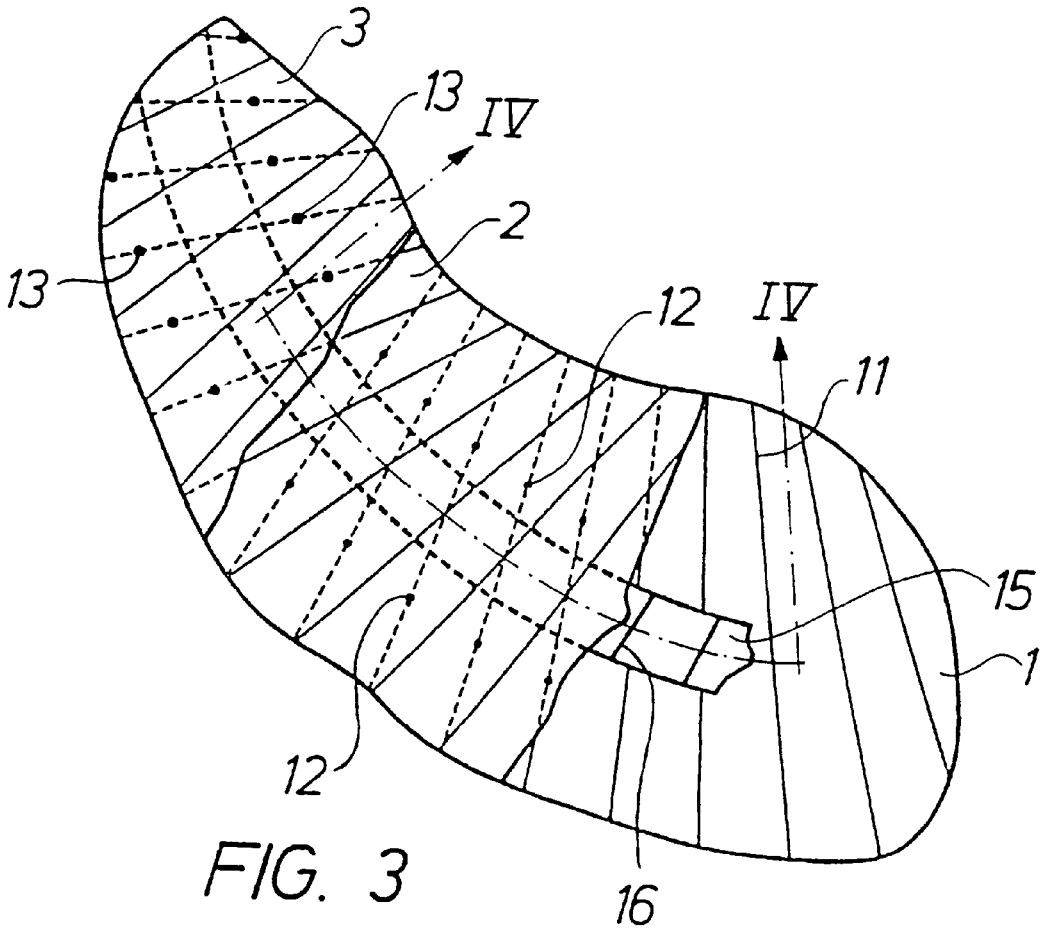
FIG. 3 is a detail view of the region III of FIG. 2, with three individual exposed, superimposed heat exchange plates and the associated gasket.
Figure 4:
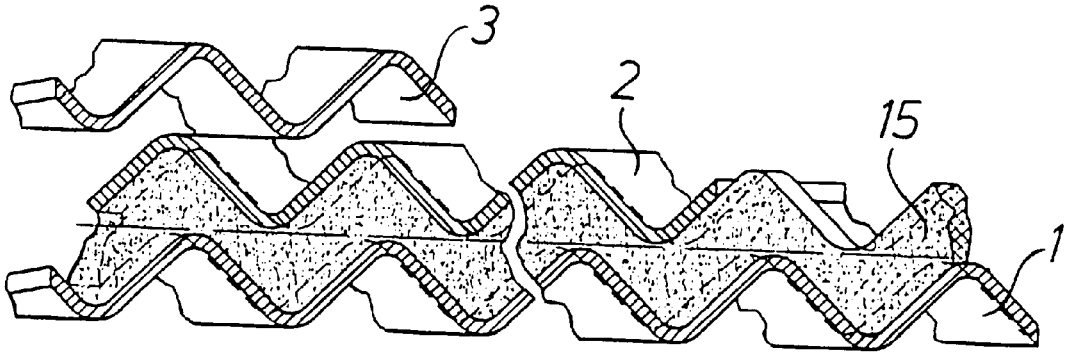
FIG. 4 is a cross-section view corresponding to the view line IV of FIG. 3.
Figure 5:
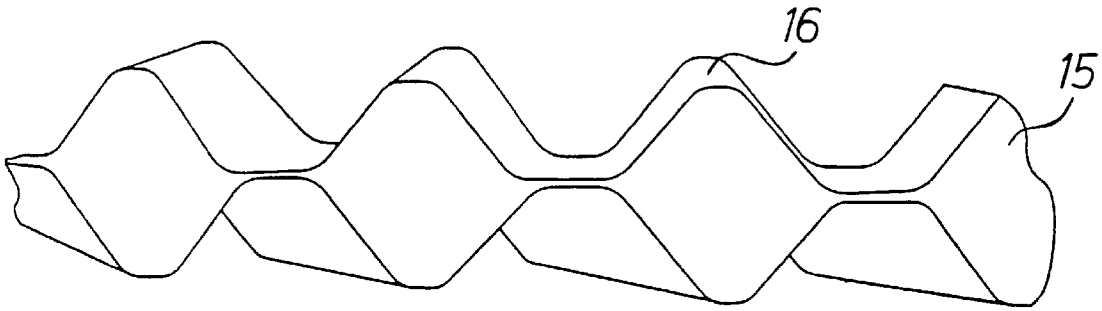
FIG. 5 is a perspective view of a gasket adapted to the corrugation.

The heat exchanger plate according to FIG. 2 is shown without a gasket in position, the extent of the gasket 10 being plotted by dotted lines in the region of the opening 9, as an inserted gasket 15 would be positioned (see FIGS. 3, 4, 5). From this figure it is clearly shown that, in the outlet region of the entry and exit openings 8, 9, a gasket groove is completely eliminated and that the profile is continuous over the extent of the gasket 10. At the circumference of the heat exchanger plate, a gasket groove 6 is provided as is conventional, accommodating the peripheral gasket. However, according to the second aspect of the invention, also the peripheral gasket groove is eliminated, as is discussed below.

In the detail view of FIG. 3 a top heat exchanger plate 3 and underlying heat exchanger plates 2 and 1 are illustrated, in which the underlying heat exchanger plates are exposed. Between the bottom heat exchanger plate 1 and the intermediate heat exchanger plate 2 the gasket 15 is inserted, while no gasket is provided between the top and intermediate heat exchanger plates. This gap or channel carries flow, the optimal flow conditions being obtained because of the missing gasket groove.

As is clearly seen in FIG. 3, crossing points 12 are obtained between the corrugation hills 11 of the lower heat exchanger plate 1 and the corrugation troughs of the intermediate heat exchanger plate 2, the crossing points flanking the gasket 15 on both sides. Only the hills or ridges of the corrugations are shown. Also, such crossing points 13 are obtained between the corrugation hills 11 of the intermediate heat exchanger plate 2 and the corrugation troughs of the top heat exchanger plate 3. Because of the uninterrupted extent of the profiles between the support points 12 and 13, respectively, the desired stiffness is obtained to apply the gasket pressure on the gasket 15.

The configuration of the gasket 15, over the extent 10 of the gasket, is adapted to the cross-section obtained between the heatexchanger plates, that is also the gasket 15 has corrugation hills 16 and interposed corrugation troughs, the corrugation hills 16 of the upper surface of the gasket crossing the corrugation troughs of the underside of the gasket. This is best shown in FIGS. 4 and 5. Thereby, the gasket cross-section is arranged so that substantially the same gasket pressure exists in a plate pack compressed between the clamping plates 4, 14 of the plate heat exchanger.

Figure 6:
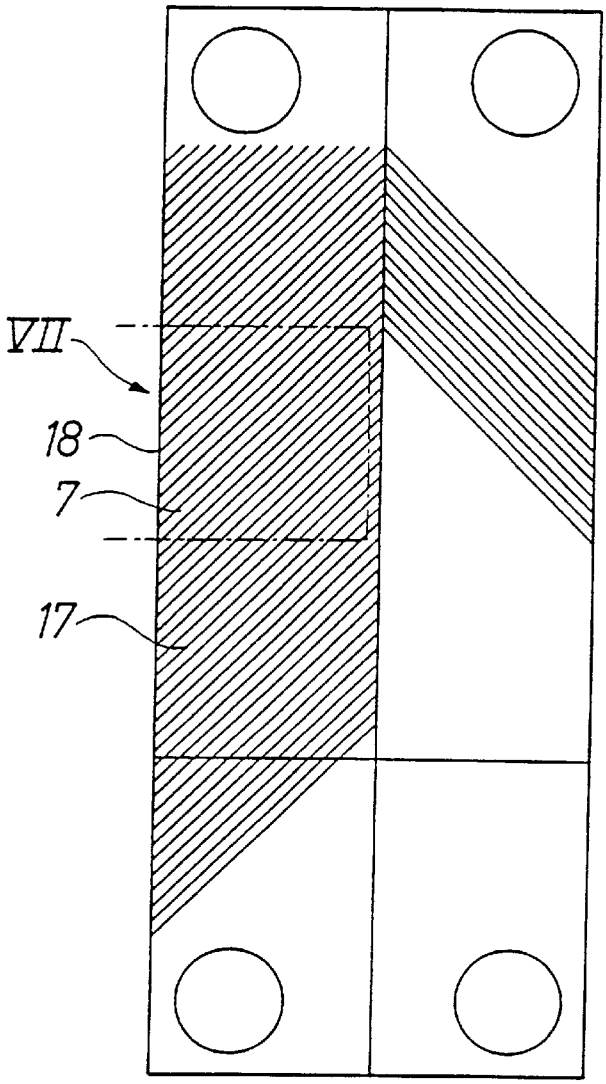
FIG. 6 is a plan view of a heat exchanger plate in accordance with the second aspect of the invention.

FIG. 6 illustrates a second embodiment of the present invention wherein the corrugations 17 of the heat exchanger surfaces 7 extend uninterrupted to the edge 18 of the heat exchanger plate. Only some of the corrugations are shown in the figure while it is understood that the whole heat exchanger plate is covered by corrugations. The corrugations may be of the same shape as in the previous figures. The invention is equally applicable to any shape of the corrugations.

Figure 7:
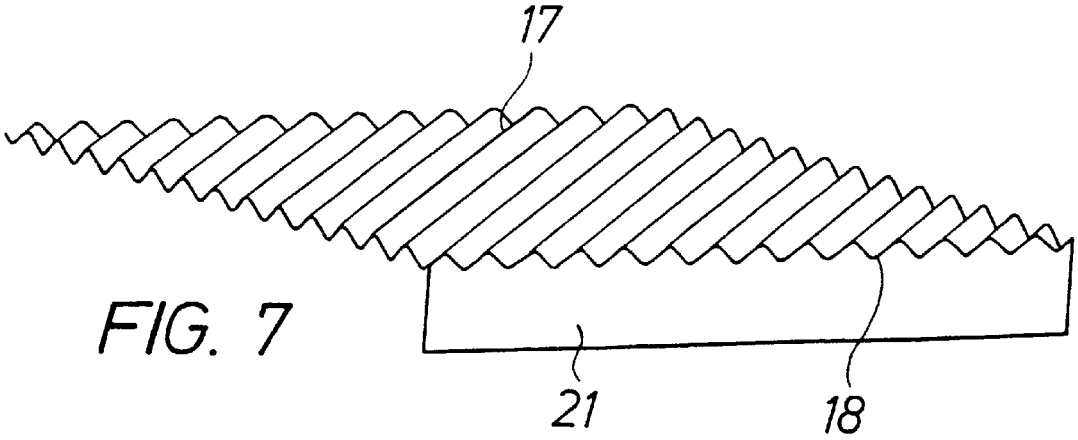
FIG. 7 is a detail view of the framed region VII of FIG. 6.

FIG. 7 is a detail view of the framed region VII of FIG. 6. As is shown in FIG. 7, the edge 18 of the heat exchanger plate is provided with a flange 21. In a plate heat exchanger of the clamping plate type as is shown in FIG. 1, the flange has no significant function but adds to the stability and integrity of the plate heat exchanger. However, in a plate heat exchanger of the soldered type, that is the heat exchanger plates are soldered together without the need of any gasket, the flange 21 is used to provide a further surface for the soldering in addition to the soldering at the crossing points between the heat exchanger surfaces.

Figure 8A:
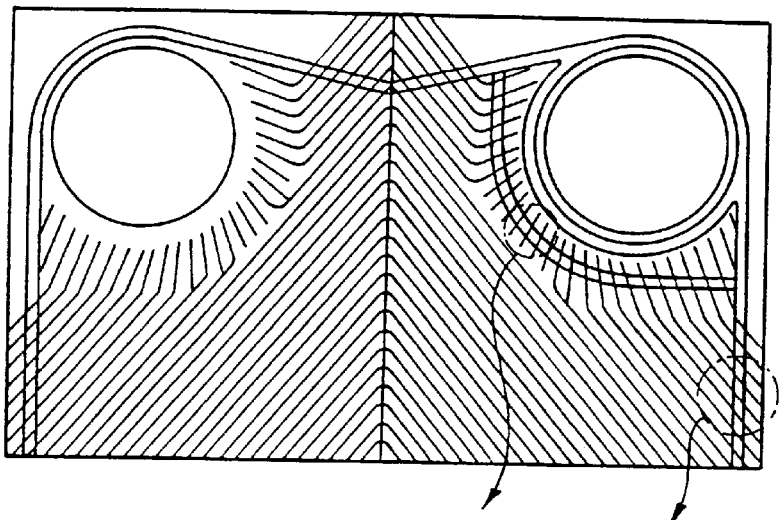
FIG. 8A is a detail view of a heat exchanger plate of FIG. 6 and the associated gasket.
Figure 8B:
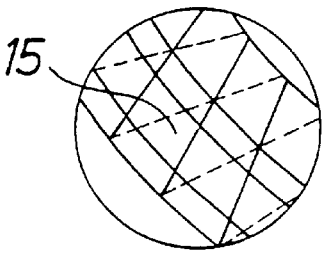
FIGS. 8B and 8C are enlarged detail views of the encircled areas of FIG. 8A.
Figure 8C:
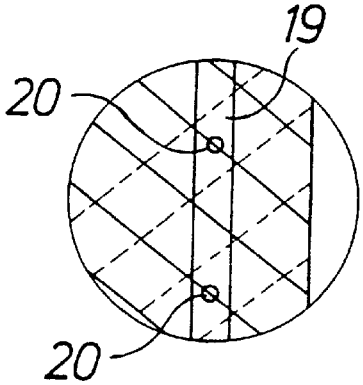

FIG. 8A is a detail view of a heat exchanger plate with the associated gasket 15, 19 placed on the heat exchanger plate 2. As is shown in FIGS. 8B and 8C similar to FIG. 3, the gasket is positioned between an intermediate plate (the broken lines depcting the hills) and a top plate (the solid lines depicting the troughs). In the region shown in FIG. 8C, the peripheral gasket 19 has a cross section corresponding to that shown in FIG. 4, but with parallel corrugations.

The corrugation of the heat exchanger surfaces (7) may intersect the peripheral gasket (19) at an angle in the range of approximately 40° to 70°. A small intersection angle results in a small pressure drop but lower efficiency of the heat exchanger, while a greater intersection angle results in a large pressure drop but greater efficiency of the heat exchanger. Thus, the angle is selected in accordance with the application of the heat exchanger.

It is preferred that the gasket is vulcanized in order to obtain the desired strength. In accordance with the third aspect of the present invention, the vulcanization is effected by means of a vulcanization press using the heat exchanger plate itself as one of the press moulds. This results in that the gasket is adhered firmly to the heat exchanger plate through the vulcanization process.

Figure 9:
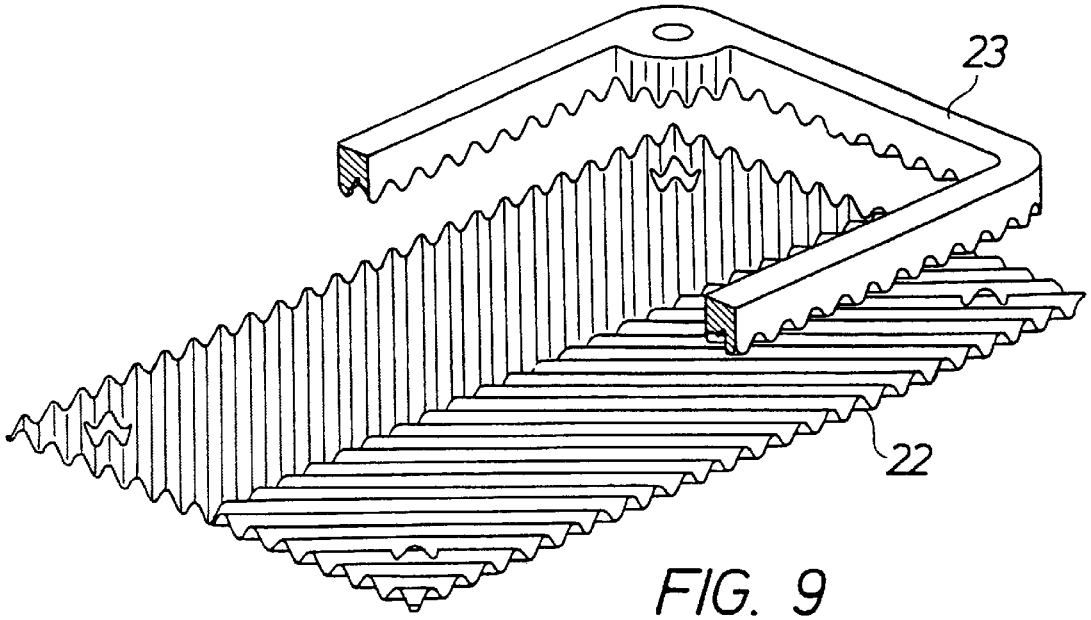
FIG. 9 is a perspective view of a heat exchanger plate and a cutaway portion of a top press mould of a vulcanization press in accordance with the third aspect of the invention.

In FIG. 9, a portion of a top press mould 23 is shown together with a heat exchanger plate 22. For the sake of better clarity in the drawings, the gasket and the rest of the vulcanization press are omitted. For the same reason, the corrugations around the exit and entry openings are simplified, while it is understood that any form of corrugations may be used. It will be appreciated by persons skilled in the art that the gasket is placed between the press mould 23 and the heat exchanger plate 22 which are then compressed and subjected to a conventional vulcanization treatment.

Figure 10:
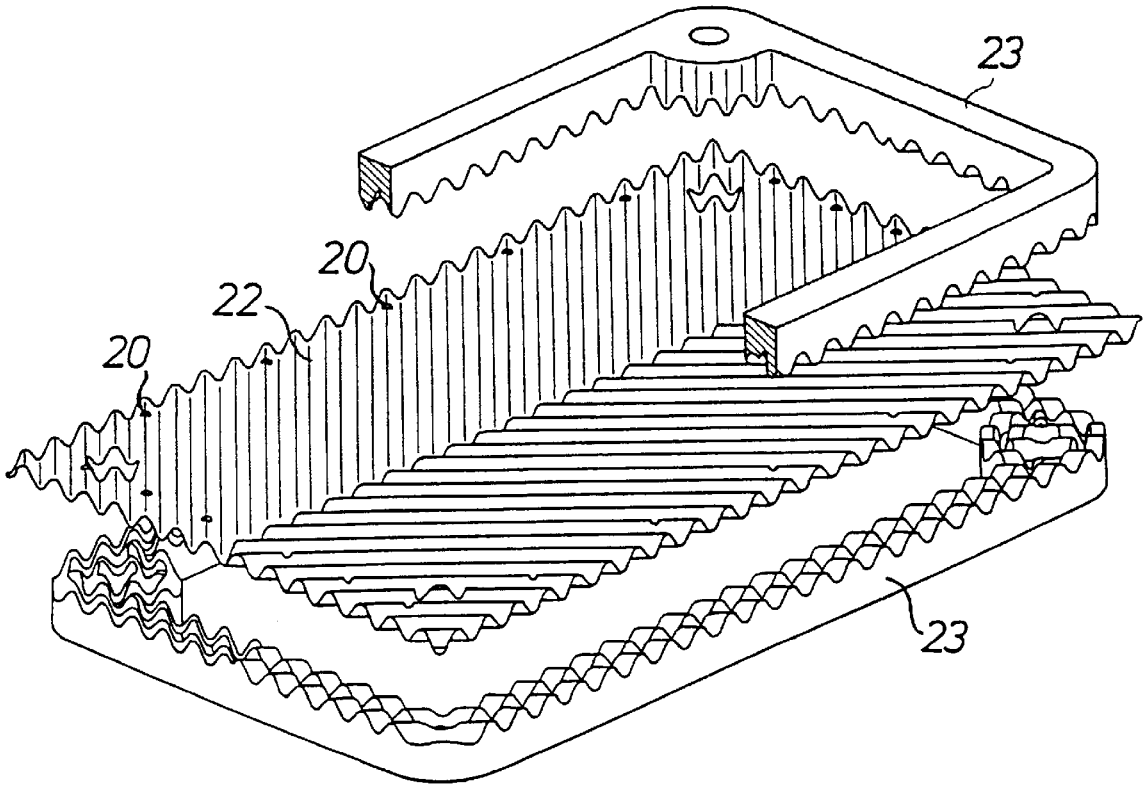
FIG. 10 is a perspective view similar to FIG. 9 additionally showing a lower press mould of the vulcanization press.

In FIG. 10 a further advantageous development is shown. In this embodiment, the vulcanization press comprises two press moulds 23 belonging to the vulcanization press proper and one heat exchanger plate 22. Thus, two gaskets are placed over and under, respectively, the heat exchanger plate 22 and are vulcanized at the same time. As is known, every second plate in a plate heat exchanger is provided with a gasket on both sides, while the other plates have no gaskets.

The adhesion of the gasket to the heat exchanger plate may be enhanced even further by providing perforations over the extent of the gasket, that is holes are provided in the plates with a suitable spacing. In FIG. 8C, two holes 20 are shown. Thus, when two gaskets are vulcanized in a vulcanization press as shown in FIG. 10 at the same time, they are bonded together through the perforations 20 resulting in a very strong binding of the gaskets together and to the heat exchanger plate.

We claim:

1. A plate heat exchanger comprising:

heat exchanger plates arranged adjacent to each other and in a compressed pack, the heat exchanger plates each having openings aligned from one heat exchanger plate to another heat exchanger plate so as to define channels configured to receive a heat emitting medium and a heat absorbing medium alternately in said channels via said openings; and gaskets arranged in gasket regions on a periphery of said openings and between the one heat exchanger plate and the another heat exchanger plate wherein;

the heat exchanger plates have corrugations extending from the openings in a substantially radial direction and uninterrupted through the gasket regions, hills and troughs of the one heat exchanger plate and the another heat exchanger plate cross at crossing points such that said one heat exchanger plate and said another heat exchanger plate support each other at the crossing points, each gasket is flanked by the crossing points, each gasket is arranged between said at least two adjacent heat exchanger plates and varies in cross-section so as to be adapted to a profile of the heat exchanger plates, and a substantially same gasket pressure is obtained over an extent of each gasket in a compressed condition.

2. A plate heat exchanger according to claim 1, wherein the corrugations of the heat exchanger plates extend uninterrupted to an edge of the heat exchanger plates.

3. A plate heat exchanger according to claim 2, wherein the corrugation of the heat exchanger plates intersect the gaskets at an angle in an inclusive range of 40° through 70°.

4. A plate heat exchanger according to claim 3, wherein the gaskets comprise vulcanized in situ gaskets.

5. A plate heat exchanger according to claim 4, wherein the heat exchanger plates define perforations located in the gasket regions and two gaskets are vulcanized together through the perforations.

6. A plate heat exchanger according to claim 5, wherein the heat exchanger plates comprise flanges.

7. A plate heat exchanger according to claim 4, wherein the heat exchanger plates comprise flanges.

8. A plate heat exchanger according to claim 3, wherein the heat exchanger plates comprise flanges.

9. A plate heat exchanger according to claim 2, wherein the heat exchanger plates comprise flanges.

10. A plate heat exchanger according to claim 1, wherein the heat exchanger plates comprise flanges.

11. A method of producing a plate heat exchanger comprising steps of:

forming openings in heat exchanger plates:

forming corrugations on said heat exchanger plates, said corrugation extending from the openings in a substantially radial direction uninterrupted through gaskets regions located on a periphery of said openings; and vulcanizing gaskets in a vulcanization press and positioning said gaskets in said gasket regions and between adjacent heat exchanger plates, said vulcanizing step includes pressing said gasket with at least one of said heat exchanger plates.

12. A method according to claim 11, wherein said pressing step comprises pressing with a heat exchanger plate as an intermediate press mold between two gaskets to be vulcanized and two press molds of the vulcanization press.

13. A method according to claim 12, further comprising perforating the heat exchanger plates in the gasket regions.

14. A method according to claim 13, wherein said vulcanizing step comprises vulcanizing two gaskets through perforations.

15. A method according to claim 11, wherein said step of forming corrugations comprises forming corrugations uninterrupted to an edge of the heat exchanger plates.

16. A method according to claim 11, wherein said step of forming corrugations comprises forming corrugations at an angle with said gaskets, said angle being in an inclusive range of 40° through 70°.

17. A method according to claim 11, wherein said vulcanizing step comprises vulcanizing the gaskets in situ.

18. A method according to claim 11, further comprising forming flanges on said heat exchanger plates.

19. A plate heat exchanger according to claim 1, wherein the corrugations intersect the gaskets at an angle in an inclusive range of 50° through 80°.

* * * * *